US005826870A

United States Patent [19]

Vulgamore et al.

[11] Patent Number: 5,826,870

[45] **Date of Patent: *Oct. 27, 1998**

[54] DIVIDER SHEET FOR STACKED PRODUCTS AND METHOD OF SUPPLYING PLANAR ARTICLES

[75] Inventors: Gary Vulgamore; Kevin T. May, both of Marietta, Ga.

[73] Assignee: Riverwood International Corporation, Atlanta, Ga.

[ * ] Notice: The term of this patent shall not extend beyond the expiration date of Pat. No. 5,447,299.

[21] Appl. No.: 458,140

[22] Filed: Jun. 2, 1995

Related U.S. Application Data

[63] Continuation-in-part of Ser. No. 192,888, Feb. 4, 1994, Pat. No. 5,447,299.

[51] Int. Cl.[6] ..... B65H 5/00

[52] U.S. Cl. ..... 271/1; 271/31.1; 271/104; 271/167; 221/26; 221/41; 221/211; 428/136

[58] Field of Search ..... 428/130, 136; 221/36, 40, 41, 26, 211; 271/1, 31.1, 100, 107, 104, 167; 414/797, 797.4, 798.9; 229/134, 900; 493/122, 123

[56] References Cited

U.S. PATENT DOCUMENTS

| | | | |
|---|---|---|---|
| 2,264,489 | 12/1941 | Tiegler et al. | 428/136 |
| 2,342,571 | 2/1944 | Carroll | 271/18 |
| 2,863,661 | 12/1958 | Picking | 271/44 |
| 2,935,315 | 5/1960 | Socke | 271/1 |
| 3,049,347 | 8/1962 | Dussart | 271/8 |
| 3,210,072 | 10/1965 | Baker et al. | 271/31.1 |
| 3,215,427 | 11/1965 | Pierce, Jr. | 271/27 |
| 3,411,695 | 11/1968 | Cupo | 229/900 |
| 3,750,931 | 8/1973 | Dick | 221/211 |
| 3,819,057 | 6/1974 | Cato | 221/211 |
| 4,015,768 | 4/1977 | McLennan | 229/134 |
| 4,505,422 | 3/1985 | Vossen | 229/134 |
| 4,518,301 | 5/1985 | Greenwell | 221/41 |
| 5,048,811 | 9/1991 | Hochbein | 271/5 |
| 5,057,066 | 10/1991 | Nagahashi et al. | 271/104 |
| 5,067,702 | 11/1991 | Muraishi et al. | 271/134 |
| 5,105,931 | 4/1992 | Lashyro | 198/471.1 |
| 5,131,899 | 7/1992 | Nagahashi et al. | 493/317 |
| 5,246,113 | 9/1993 | Schuster | 206/430 |
| 5,447,299 | 9/1995 | May | 271/1 |

*Primary Examiner*—H. Grant Skaggs
*Attorney, Agent, or Firm*—Isaf, Vaughan & Kerr

[57] ABSTRACT

A planar article or sheet, such as a divider sheet for stacked products, and the method of supplying substantially planar articles from a supply magazine to an article transfer device, which then transfers the article to a desired location for further processing. The planar article itself can be a divider sheet for stacked beverage containers, folded paperboard cartons for carriers, or any other substantially planar article which is adapted to be consecutively arranged with other such articles in a group, and placed in a supply magazine for singular delivery to an article transfer device. The method of the present invention is specifically designed to insure that only one sheet at a time is removed from the group by the article transfer device. The sheets or articles themselves, are designed to cooperate with the supply magazine to facilitate singular delivery. The articles also can incorporate several features, alone or in combination, which reduce the force necessary to accomplish their removal and reduce the likelihood that consecutive articles will adhere to one another and be unintentionally removed from the stack of articles upon the intended removal of one article by the transfer device.

21 Claims, 6 Drawing Sheets

DIVIDER SHEET FOR STACKED PRODUCTS AND METHOD OF SUPPLYING PLANAR ARTICLES

RELATED APPLICATION

This document is a continuation-in-part of the application entitled "DIVIDER SHEET FOR STACKED PRODUCTS AND METHOD OF SUPPLYING PLANAR ARTICLES," filed Feb. 4, 1994, by Kevin T. May, and assigned Ser. No. 08/192,888, now U.S. Pat. No. 5,447,299.

FIELD OF THE INVENTION

This invention relates to divider sheets for stacked products, such as beverage containers packaged in stacked relationship within a paperboard carrier or carton. This invention also relates to other substantially planar articles especially adapted to be received and held in a supply accumulation magazine for selective distribution of a single article, and to a method of supplying substantially planar articles, such as divider sheets and folded cartons, from a supply magazine to an article transfer device, which then transfers the article to a desired location for further processing. The present invention, therefore, is not limited to divider sheets or boards, but includes substantially any planar article or sheet which must be singularly processed from an accumulation magazine, and the method of supplying such articles.

BACKGROUND OF THE INVENTION

Numerous manufacturing or processing operations involve the storage, supply and transfer of planar articles from one location to another. For example, sleeve-type carriers used to package beverage containers typically are formed from paperboard blanks which have been folded into collapsed, substantially flat form. A group or quantity of such folded paperboard carriers are consecutively arranged or loaded into a supply magazine, which delivers the carriers to an article transfer device. The article transfer device removes one carrier at a time from the supply magazine, and transfers the carrier to the desired location for further processing. The apparatus and method typically used in such operations are disclosed in U.S. Pat. No. 5,105,931, and in other of the U.S. Patents referred to therein. Another example of the supply and transfer of substantially planar articles in a manufacturing process also concerns the packaging of beverage containers, and specifically relates to supplying divider boards, such as paperboard separator sheets, in a packaging operation in which groups of stacked beverage containers are packaged in a sleeve-type carrier. U.S. Pat. No. 5,246,113 discloses various types of dividers or separator sheets and paperboard carriers.

A common requirement in the processing of both folded cartons and substantially planar divider sheets in such a packaging operation is that the cartons and divider sheets be continuously supplied during high-speed packaging processing, so that a single carton or sheet can be transferred from a supply area to a processing area. In order to accomplish such high-speed material transfer in packaging operations, large groups of cartons and dividers, for example, hundreds or even thousands in number, are arranged consecutively in a supply magazine which gravity feeds the articles to an article transfer device, such as the rotary multi-engagement device disclosed in U.S. Pat. No. 5,105,931. Some supply magazines include a powered mechanism to selectively feed the articles to the article transfer device. The present invention works effectively with either gravity fed or powered magazines. Such transfer devices are commonly known, and typically utilize vacuum engagement between the transfer device and the outermost or exposed article surface to remove the single article from the supply magazine, and then transfer the article to another location for further processing.

Typically, the grouped cartons or divider sheets are held in the supply magazine by upwardly and/or downwardly depending retaining bars or clips. The bars are selectively disposed over the upper and lower side edges of the article sufficiently to releasably retain the article in the magazine, while allowing the vacuum engagement by the rotary transfer device to selectively remove an article or articles from engagement with the retaining bars. It is intended that only a single article be removed from the supply magazine by each vacuum engagement member. This specific process step, that is, selectively removing only one carton or divider sheet at a time from the supply magazine, can be very problematical. If the retaining bars of the magazine or hopper do not sufficiently overlap the edges of the article, the article group will not be retained in the hopper. Conversely, if the retaining bars overlap too great an extent, the article can be restrained from being easily picked by the vacuum transfer device. Trial and error adjustment of both the amount of such engagement and the force of the vacuum applied by the rotary transfer device usually are necessary to accomplish smooth operation in this process step. Even with the ability to adjust these process variables, however, it is often very difficult to cause this process to operate continuously at very high speeds while maintaining a high degree of efficiency.

In supply magazines which include a powered mechanism to push or feed the articles to the article transfer device, the articles are driven forwardly by a controlled amount of force. It is known that both too much force and too little force of the articles against the retaining bars or clips can adversely affect the process. In other words, there is a range or "window" of force which will be optimum, depending upon other parameters such as the size and type of article, the amount of overlap by the clips and the type of article transfer device. One approach to controlling the amount of force applied, is to construct the mechanism holding the retaining clips so that the force or pressure of the articles against the clip causes the clip retaining mechanism to transfer the applied force to a load cell where the force is measured. This measured pressure or force is recognized by a controller, which adjusts the powered feed mechanism accordingly to maintain the force within the desired range. While this arrangement has been found to be extremely satisfactory for many types of articles, such an arrangement also includes the necessary mechanical and electronic elements for its operation.

Another problem associated with supplying a substantially flat, planar article in a high speed, continuous manufacturing operation, such as beverage container packaging, is that a vacuum effect tends to be created between successive articles in the hopper, causing more than one article to be pulled from the hopper by the transfer device due to the tendency of the second article to temporarily adhere to the first or selected article. This is very undesirable, because the entire high speed operation can be interrupted if more than one article is selected, thereby causing an extreme loss of efficiency in the operation. This adherence between articles is the result of the articles necessarily being consecutively stacked, or arranged in large groups within the hopper which extends at a downward angle toward the rotary transfer device in order to allow the articles to be gravity fed.

Consequently, there is little or no space between the articles, which creates a vacuum effect. That is, when the outermost article is pulled from the article group, one or more additional articles tend to be momentarily attracted to or held to the outermost article, causing one or more additional articles to be pulled from the hopper. This problem is not restricted to packaging operations in which substantially planar cartons or divider sheets are supplied in a continuous packaging operation. Many other high speed, automated processes which handle substantially planar articles also utilize gravity feed supply hoppers and article selection devices to select a single article from the hopper, and transfer the single article for further processing during the high-speed operation. These include practically all types of material packing operations which involve the handling of planar articles, including such operations which insert coupons, postcards or other planar articles or sheets into a packaged product, magazine, or envelope.

Although advances in the processing or packaging of articles have resulted in more efficient, more productive and higher speed article processing, the delivery of substantially planar articles in a manner which ensures singular article section has remained a problem area in the process or operation.

SUMMARY OF THE INVENTION

The present invention comprises a substantially planar article or sheet, such as a folded carton or divider, especially adapted to be grouped with other such articles and disposed in an article supply hopper for singular selection during a continuous, high speed process. The invention also concerns the method of supplying such articles in a processing operation.

The present invention can comprise, for example, a divider sheet used to separate layers of stacked beverage containers which are contained in a paperboard carton or carrier. One embodiment of the sheet includes at least one notched area along one edge, which communicates with a stationary retaining pin or bar of the supply magazine assembly. This magazine is arranged so that a group of sheets is gravity fed to a selection area, with the first or outermost sheet abutting the retaining pin of the supply magazine assembly. The sheets within the group contained in the supply assembly abut one another in consecutive relationship, so that the group of sheets, and each sheet contained therein, is prevented from unintentional distribution by the outermost sheet being held in place, blocking the selection area. Each sheet within the group includes at least one notched area along at least one corresponding edge, although two or more notches can be utilized per sheet. If one notch is used, the notch typically is positioned at or adjacent to the midpoint of the sheet edge. If two notches are used, the notches typically are positioned or spaced on either side of the edge midpoint, further toward the ends of the sheet.

Each respective sheet within the article group contains the same number of notches, with the notches being positioned so that all of the notches of every other consecutively arranged sheet are in linear alignment. The notches are sized to be of a width larger than the width of the supply assembly retaining pin. The supply assembly or magazine includes at least one group of two, spaced retaining pins. When the article group is consecutively arranged in the supply assembly for distribution, a first retaining pin contacts a side edge of the outermost article or sheet to releasably retain the sheet in the supply storage assembly and effectively block the selection area. The second retaining pin is positioned to be within the notch or opening defined in the first sheet edge, so that the second pin contacts or is in a position to contact the second sheet, which sheet abuts the first or outermost sheet. The sheets within the group usually are identical, except that the notch of the second sheet is positioned so that the first pin contacting the side of and retaining the first sheet will be positioned within the notch of the second sheet when the first sheet is removed from the supply assembly and the second sheet is indexed forwardly to become, in effect, the outermost sheet. The first pin then is received within the notch of the second sheet, and thereby contacts the third sheet. As stated, the notches of every other sheet are in linear alignment so that as the outermost sheets arranged in the supply assembly are each removed and the remaining sheets are indexed forwardly, one of the stationary retaining pins contacts the outer side of the outermost sheet while the other retaining pin is positioned within the notch of the outermost sheet. When the outermost sheet is removed, the functions of the pins are reversed, with the first pin being positioned within the notch of the new outermost sheet and the second pin contacting the outer side of this sheet blocking its unintended removal from the supply assembly. As each consecutive outermost sheet is progressively removed, the functions of the retaining pins continuously reverse.

In the process of this embodiment of the present invention, the outermost sheets typically are removed from the supply assembly by an article transfer device, which utilizes vacuum engagement to remove the outermost sheet. The vacuum engagement member contacts the outer side of the outermost sheet at a selection area at the end of the supply assembly and adheres the sheet to it. The article transfer device then pulls this sheet from the supply assembly. The sheets usually are comprised of paper, paperboard, plastic or like material which is deformable, allowing the engagement member to flex the sheet and pull the sheet away from the supply assembly so that the sheet slides under and away from the retaining pin contacting the outer side, thereby removing the sheet from the supply assembly. As the outermost sheet is being removed from the assembly, the second retaining pin, positioned within the notch of the outermost sheet, contacts the second sheet and holds the second sheet in place while the outermost sheet is being removed. The contact of the second pin with the second sheet overcomes the friction and vacuum forces which tend to be present between the outermost or first sheet and the second sheet, which forces may otherwise pull the second sheet away from the supply assembly along with the outermost sheet. When the outermost sheet is removed, the second sheet then indexes forwardly by gravity and thereby becomes the outermost sheet. Similarly, the vacuum engagement means contacts the new outermost sheet, and pulls this sheet from the supply assembly. The functions of the stationary retaining pins is now reversed, with the second pin tending to releasably engage the side edge of the new outermost sheet and the first pin now holding the next consecutively arranged sheet within the group, the third sheet, from unintentional removal. In such processing operations, the article transfer device normally employs numerous engagement members which continuously remove and distribute the sheets from the supply assembly at high speeds of, for example, hundreds of sheets per minute.

Another embodiment of the present invention relates to another divider sheet which does not include spaced notches, but includes spaced tabbed engaging sections. These tabbed engaging sections comprise weakened areas along at least one side edge of the divider sheet. These weakened areas themselves include individual tabs defined at the side edges by spaced slits cut into the divider sheet. Each tabbed engaging section includes at least one tab connected to the body of the sheet by a bridge, which prevents the tab from unintentionally bending or separating from the remainder of the divider sheet. Preferably, the tabbed engaging section includes three individual tabs, connected together or to the body of the sheet by bridges. Although one tabbed engaging section or area can be used, the preferred form of this embodiment includes two spaced tabbed areas along the upper side of the sheet spaced toward the corners from the midpoint, and positioned so that the tabbed engaging areas of each sheet will abut the retaining clips when the sheet is advanced forwardly in the supply magazine to be the outermost sheet.

These tabbed engaging or weakened areas perform a specific function during the process of delivering the sheet of this second embodiment from the supply hopper. As the article transfer mechanism engages the outermost sheet with the vacuum cups, the transfer mechanism begins to pull the outermost sheet from beneath the retaining clips. As in all cases, the sheet resists this outward movement to an extent. This resistance is a function of the force or pressure of the sheet against the clips and ultimately of the extent of friction between the sheet side edges and the clips. As the sheet of this embodiment is pulled outwardly away from the hopper, the engagement between the clips and the weakened area tends to bend the weakened area and partially, but not entirely, break the tabbed area away from the body of the sheet. The continued urging of the sheet away from the hopper finally pulls the remaining or tabbed portion of the sheet from beneath the clips, thereby releasing the sheet from the hopper. Using this embodiment of the present invention requires less force to pull the sheet from the magazine, as opposed to conventional sheets without the weakened areas. Additionally, the use of the sheets of this embodiment leads to the process itself being much less sensitive to the adjustment of force or pressure against the clips by the face edges of the sheet. In other words there is a larger force adjustment range which will work satisfactorily. While in conventional processes of supplying divider sheets the amount of pressure exerted by the sheet against the clips is of primary importance, in this embodiment of the present invention, the amount of pressure exerted against the clips are force less important.

The sheets themselves of each embodiment can include additional features which assist in insuring that only one sheet at a time is selectively removed from the supply assembly. The sheets can be formed with ridges in one surface, so that as the sheets are consecutively arranged in the supply assembly, the ridges of each sheet tend to abut the surface of the adjacent sheet, spacing the adjacent sheets apart and allowing the atmosphere to enter between the sheets. Typically, these ridges are formed by stamping or pressing indentations in one side of the sheets, with the corresponding ridges being pressed outwardly in the opposite sheet side. Further, the sheets themselves can be made to define apertures therethrough at spaced intervals, preferably so that the apertures will be positioned over the indentations or ridges in the next, consecutive sheet, to further facilitate the passage of air between the consecutive sheets.

The features of the notches or the tabbed engaging areas, and the indentations, ridges, or apertures can be combined to provide for optimum efficiency in the selective removal of a single sheet from the supply assembly, to overcome the problem of two sheets unintentionally being simultaneously removed from the assembly. These and other benefits of these inventions will become clear from the following description by reference to the drawings.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

DETAILED DESCRIPTION OF THE PREFERRED EMBODIMENTS

Figure 1:
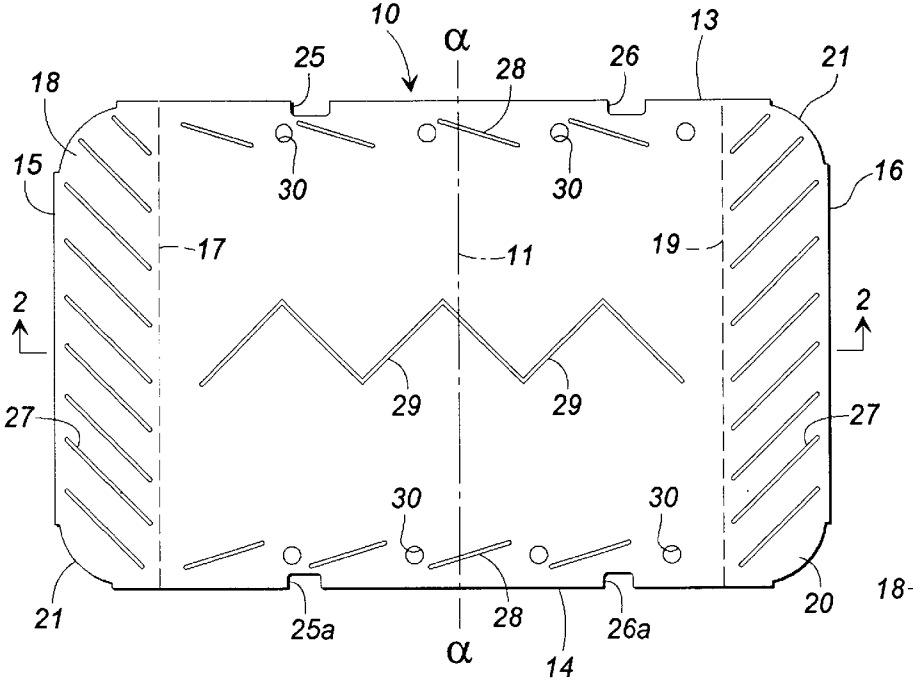
FIG. 1 is an elevational view of one embodiment of the sheet assembly of the present invention.

Referring to FIG. 1, a sheet in the form of a stacked beverage container divider 10 is shown as one example of an apparatus of the present invention. Divider 10 preferably is comprised of paperboard, and is substantially flat or planar. The divider illustrated in FIG. 1 is rectangular, having a first or outer surface 11 and a second or inner surface 12. Divider 10 further includes opposed elongate side edges 13 and 14, and opposing side edges 15 and 16 transversely aligned to edges 13 and 14. Crease or fold line 17 is spaced inwardly from side edge 15 to define therebetween flap 18. Similarly, crease or fold line 19 is spaced inwardly from side edge 16 to define therebetween flap 20. The divider shown in FIG. 1 includes rounded corner edge portions or corners 21. The divider includes two slots or notches 25 and 26 defined in elongate edge 13. Notches 25A and 26A corresponding to and positioned directly opposite notches 25 and 26, respectively, are defined in elongate edge 14. For the purposes of the present embodiment, notches 25A and 26A are not necessary for the operability of the present invention, and edge 14 can run continuously from fold line 17 to fold line 19 without defining a notch therein. Positioning notches 25A and 26A in the second or lower elongate edge 14, along with flaps 18 and 20 formed at each end of the divider, permits the divider to be loaded into the supply hopper assembly either with edge 13 or edge 14 being in the top or upper position. FIG. 1 also shows center line a which runs along the midpoint between edges 15 and 16, respectively, which also can be considered the transverse axis of the divider illustrated. The dimensions of the notches and their specific positioning along the side edges 13 and 14 are discussed below. Further, while the embodiment disclosed for purposes of the present invention includes two notches along each opposing elongate side edge, as hereinafter discussed the present invention also will perform acceptably either with one notch or with more than two notches.

Figure 3:
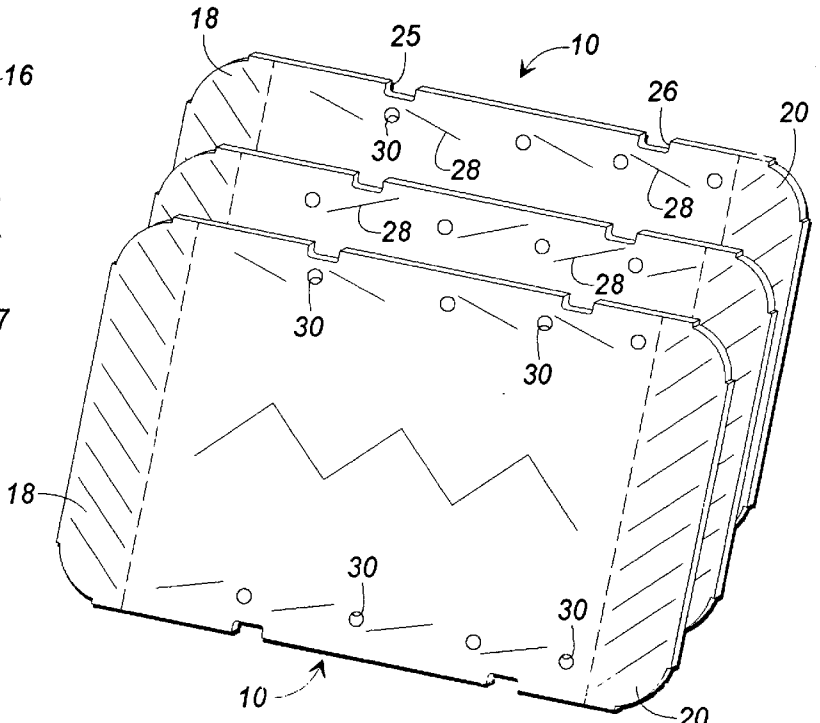
FIG. 3 is a perspective view of three consecutively arranged sheets of the present invention.
Figure 2:
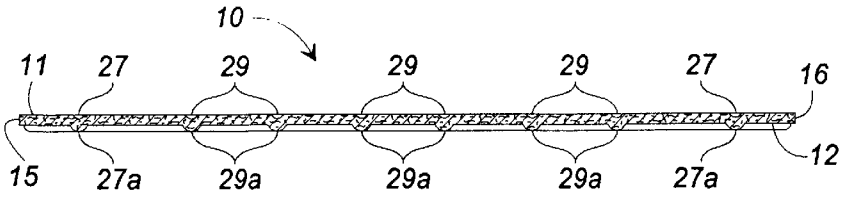
FIG. 2 is a cross-sectional view of the sheet of FIG. 1, taken alone lines 2—2.

Although the present invention is found to function acceptably when the sheet or, in this example, divider 10, is entirely planar, the sheet can be scored with indentations and ridges, which assist in permitting air to pass between consecutively or successively stacked sheets when, for example, the sheets are stacked in a supply magazine. As is well known, elongate indentations can be stamped into paperboard, paper, or plastic sheets by a metal die and press, so that a score line or indentation is stamped into one side of the sheet and a ridge or protrusion corresponding to the stamped indentation extends from the opposite side of the sheet. In the automated, continuous, high speed supply and distribution of dividers for use in a beverage container packaging operation, it has been found useful to score the dividers as shown in FIG. 1, with indentations 27, spaced, parallel and extending angled to fold lines 17 and 19 up to a position adjacent edges 15 and 16, respectively. A series of spaced, angled indentations 28 are scored in the divider adjacent the elongate edges 13 and 14, respectively. Indentation 29 runs along the approximate middle portion of the divider from fold line 17 to fold line 19, shown in FIG. 1 at about its longitudinal axis, and can be jagged or non-linear in order to increase its overall length. Since the indentations are stamped or scored into the upper surface 11 of the divider, corresponding ridges 27A, 28A (not shown) and 29A are formed to protrude or extend outwardly from the opposing, second or inner side 12, as shown in FIG. 2. In order to further increase the effectiveness of the indentations and ridges formed in the divider, the divider also defines apertures 30 therethrough. The apertures are positioned so as to be arranged directly adjacent to either an indentation 28 or a ridge 28A formed in the next adjacent sheet or divider 10 when the dividers are arranged in a group, as shown in FIG. 3.

While the present invention ideally is suited for carton dividers or pads, it also can be effectively used for paperboard carriers, or folder cartons, in the packaging art, and further is ideally suited for many other automated, high speed processing operations in which a substantially planar sheet is to be selected from a supply or accumulation magazine in singular fashion, and thereafter transferred to another location. Such an application includes coupons and other informational literature inserted into products, or packaging and magazines or literature inserts, such as subscription cards.

Figure 4:
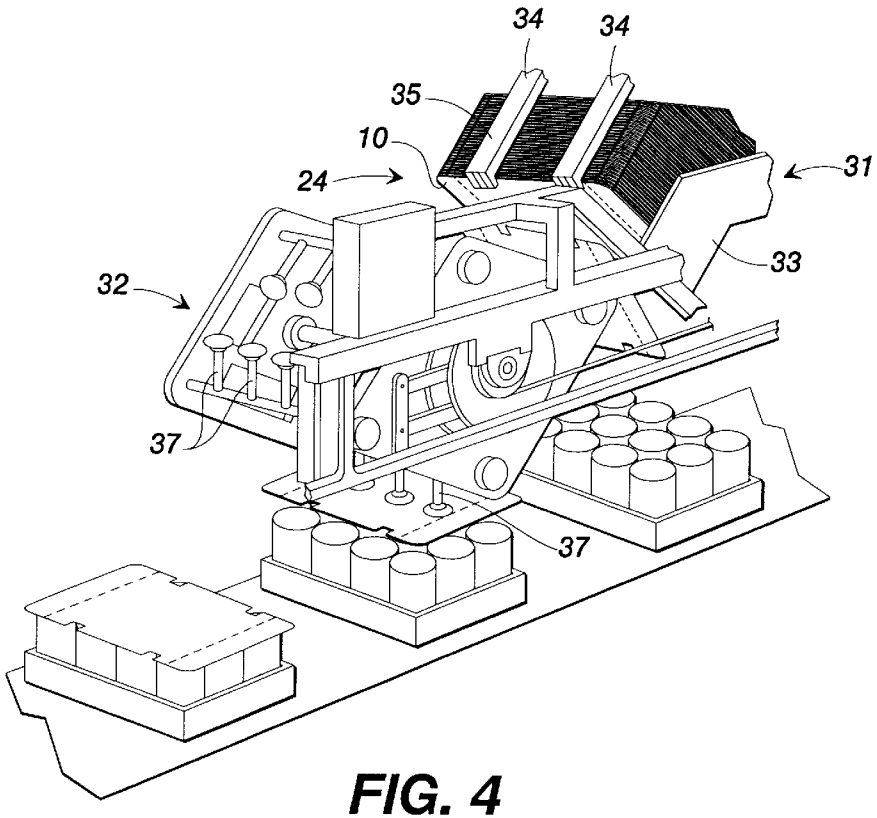
FIG. 4 is a perspective, schematic view of an article transfer device removing sheets from a supply magazine assembly.

FIG. 4 discloses a group of carton dividers 10 consecutively or successively arranged and disposed in a supply magazine 31, which communicates with a rotary transfer device 32. The supply magazine 31 is of a type generally known in the art, and includes a downwardly extending magazine or hopper 33 into which the groups of successively arranged divider sheets 10 are placed. Typically such supply assemblies include an article engagement mechanism in the form of a retaining bar or pin to contact the lowermost or outermost article and to block the lowermost article from unintentional distribution from the hopper 33. The remaining articles within the group are also thereby blocked from being disengaged from the hopper or from forward movement toward the rotary transfer device. The present invention includes two retaining or abutment members 34 in the form of elongate bars extending angularly toward transfer device 32. An abutment member 34 is disposed to correspond with each notch 25 and 26 of sheet 10, as described below. At the distal end 35 of each retaining member 34 are two downwardly depending retaining pins 36 and 36A which are parallel to one another and which extend a selective distance over the first or outer side 11 of the first divider sheet in the group, to engage the divider and retain it within hopper 33. As is known in the art, the extent to which retaining pins 36 and 36A, or other retaining bar or abutment member, overlaps the first or outermost sheet along any one or more sides can be selectively adjusted so that the outermost sheet is retained from being unintentionally disengaged from the hopper, but also permitting the sheet to be readily pulled from the hopper by the rotary transfer device 32. The abutment members of the present invention, however, are unique in that they include the two, spaced, parallel, downwardly depending retaining pins which are adapted to cooperate with the notches in the upper edge of the divider 10. Although, as hereinafter discussed, the present invention will perform satisfactorily with one notch along the upper edge of each sheet, which would require only one abutment member 34, instead of two notches as shown in FIG. 1, it is necessary that the abutment member include at least two downwardly depending retaining pins, so that the first retaining pin engages the lowest or outermost sheet, such as divider 10, and the second pin cooperates with the notch in the upper edge of this sheet to engage the second consecutively arranged sheet. This enables the second retaining pin to contact and hold the second sheet from being unintentionally disengaged from the hopper while the outermost or first sheet is being selected. Known selection devices which utilize rotary transfer mechanisms incorporate vacuum engagement members such as engagement members 37 which are moved along a rotary path of travel to engage the outer surface, such as side 11, of the outermost article in the hopper at selection area 24, and pull the article from the supply magazine or hopper along the path of travel.

Figure 5:
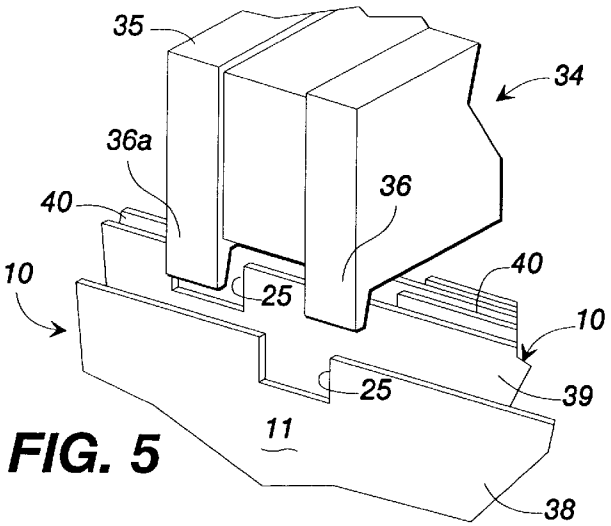
FIG. 5 is a perspective, fragmentary view of a supply assembly retaining member cooperating with the notched sheets of the present invention.
Figure 6:
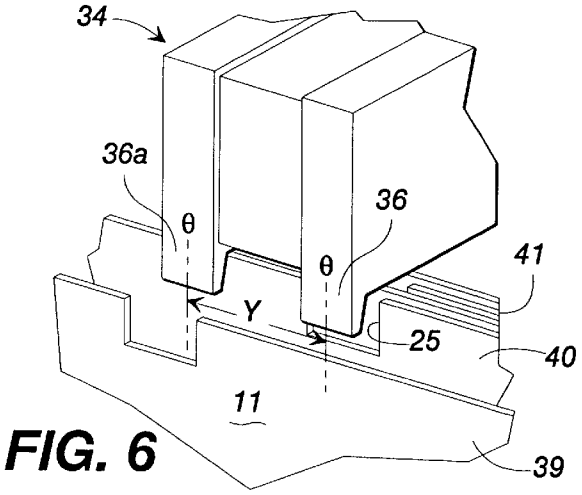
FIG. 6 is a perspective, fragmentary view of a supply assembly retaining member cooperating with the notched sheets of the present invention.

FIG. 5 shows one abutment member 34 of the present invention engaging a divider sheet 10. In FIG. 5, the lowermost or first sheet, also designated as numeral 38 for clarity, has been pulled from engagement with the abutment member 34. Retaining pin 36A functioned as the operative retaining pin that engaged and overlapped outer side 11 of outermost divider sheet 38, while retaining pin 36 cooperated with and was received in notch 25 of lowermost sheet 38 so that pin 36 engaged the second sheet 39, to hold sheet 39 as sheet 38 was being pulled from engagement with the abutment member 34 by the rotary transfer device. Each notch defined in divider 10 cooperates with one abutment member 34. After first sheet 38 is pulled from the hopper, the second sheet 39 is indexed forwardly and downwardly by gravity to engage abutment member 34, and so itself becomes the outermost sheet within the hopper. The functions of the respective retaining pins are now reversed, with retaining pin 36 actively engaging the second sheet 39 and pin 36A cooperating with and being received within notch 25 of second sheet 39 to engage the outermost side 11 of the third sheet 40 within the hopper. FIG. 6 shows the second sheet 39 being disengaged from contact with the abutment member 34. Sheet 39 has been pulled from engagement with and away from retaining pin 36, and the third sheet 40 has indexed forwardly to contact abutment member 34 by pin 36A. The functions of the respective retaining pins again are reversed, and pin 36A becomes the operative pin to releasably retain third sheet 40 while pin 36 is received within notch 25 of sheet 40 to retain fourth sheet 41 from being unintentionally removed from the hopper while third sheet 40 is being selectively removed by the rotary transfer assembly. The respective notches in every other sheet are arranged to be in linear alignment in the direction extending rearwardly away from pins 36 and 36A, to insure that each pin alternately engages the outermost side of each sheet or divider and thereafter cooperates with a notch in the next following divider, as discussed above.

Figure 7:
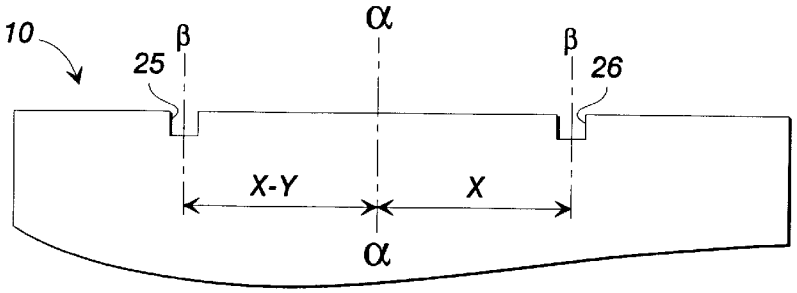
FIG. 7 is a schematic, fragmentary view of one embodiment of the sheet assembly of the present invention.
Figure 9:
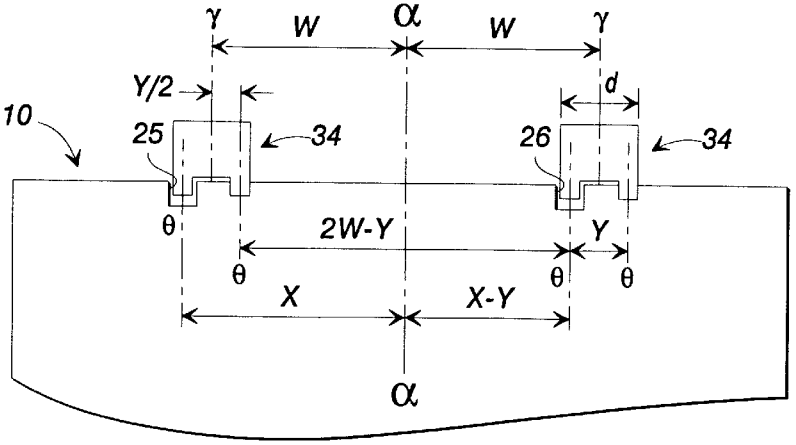
FIG. 9 is a fragmentary view of one embodiment of the sheet assembly and the abutments of the present invention.

When a two-notch arrangement in a stack of sheets is employed in the present invention as discussed above, the size and placement of the notches is considered ideal according to the relationship shown in FIG. 7. The actual size of the notch must only be large enough to allow a retaining pin to pass freely through the notch without contacting the sheet. One notch, for example, notch 26, is arbitrarily positioned a distance X from the midpoint along and edge of the sheet 10, or transverse axis $\alpha$, of the sheet 10 to the center of the notch, denoted as line $\beta$ in FIG. 7. The distance X ideally should be greater than the distance d between the outer side edges of the retaining pins 36 and 36A. The other notch 25 is positioned a distance equal to X minus Y, where Y equals the distance between the vertical center lines $\ominus$ of the pins on one abutment (FIG. 6). FIG. 9 shows a divider sheet with the locations of the notches reversed from those shown in FIG. 7. In FIG. 9, notch 25 is spaced a distance X from axis $\alpha$ and notch 26 is spaced a distance X–Y from axis $\alpha$. Also in FIG. 9, 2W equals the distance between the respective vertical center lines $\gamma$ of the two abutments in a two-notch configuration, where W is equal to X–½Y. While placement of the abutments and pins at other locations may be acceptable, placement according to the above-referenced formulae has been found to work well during high speed processing. The present invention can include two abutment members. The first abutment member is placed at one end of the stack of sheets along one edge of the top sheet and on one side of the midpoint. The first abutment member has a first retaining pin placed at a distance X from the midpoint along one edge of the sheet and a second retaining pin placed at distance X minus distance Y. One of the two retaining pins is for contacting an outermost sheet in the stack of sheets and the other retaining pin is for passing through a first notch in the outermost sheet and for contacting the second sheet in the stack of sheets.

The second abutment is placed at one end of the stack of sheets along the edge and on an opposite side of the midpoint of the first abutment member. The second abutment member has a third retaining pin placed at a first distance along the edge of that divider sheet. A forth retaining pin is placed at the distance X minus Y. One of the two retaining pins is for contacting an outermost sheet in the stack of sheets, and the other retaining pin is for passing through a first notch in the outermost sheet and for contacting the contact sheet in the stack of sheets.

Providing notches 25A and 26A in the opposing elongate edge 14 of the divider 10, as shown in FIG. 1, provides additional practical advantages in using the present invention. When divider boards are used, the presence of corresponding notches in each elongate side edge, and the presence of two opposing flaps, one at each end, permits the divider 10 to be loaded into a supply magazine 33 with either edge 13 or edge 14 placed upwardly and in a position to contact retaining pins 36 or 36A of abutment member 34. Also, since typically one flap of a divider sheet is turned down during the packaging of stacked articles such as beverage containers, the presence of a flap at either end allows a flap be folded down regardless of which of side edges 13 or 14 is placed in the upward position in the hopper. Although this incorporation of redundant elements in the present invention allows articles such as divider sheets to be loaded with either elongate edge up, some applications, such as paperboard carriers, are not suited to this versatility, since the paperboard carrier or sleeve must be oriented in a single specific position within the hopper. Even in such articles, however, the present invention will readily function.

Figure 8:
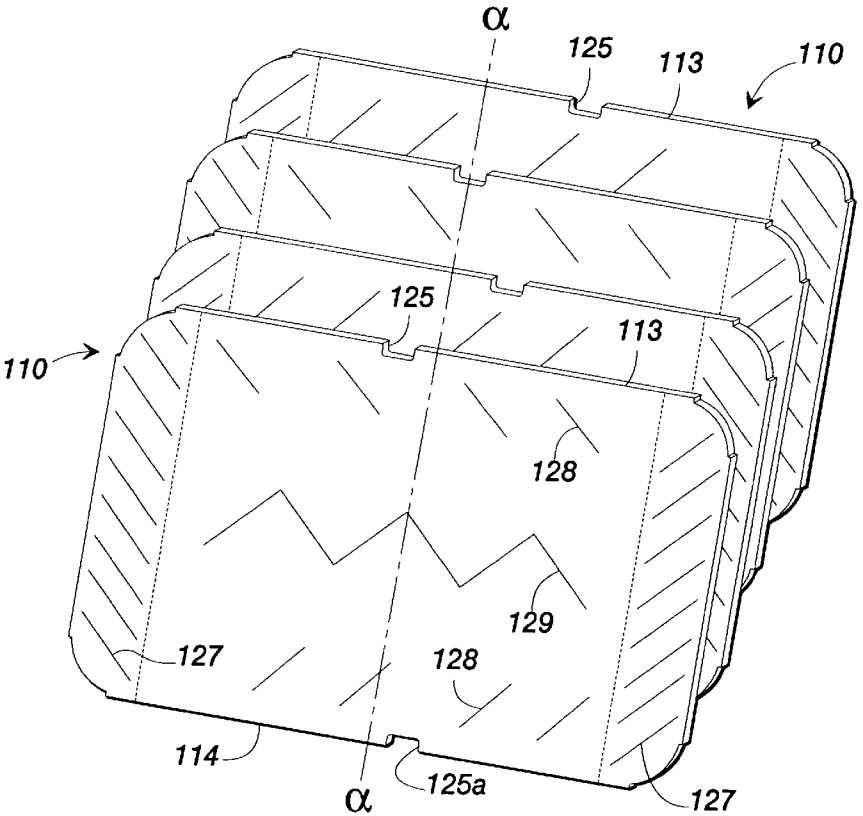
FIG. 8 is a perspective view of four consecutively arranged sheets of another embodiment of the present invention.

Another embodiment of the present invention comprises divider sheet 110 having a generally rectangular form and being substantially planar. All elements of divider sheet 110 correspond with a like element on divider sheet 10, except with respect to the notches. As shown in FIG. 8, sheet 110 includes only a single notch 125 defined in elongate edge 113 and a single notch 125A defined in opposing elongate edge 114. In this embodiment, notches 125 and 125A are positioned in side edges 113 and 114, respectively, on either side of the midpoint, shown as transverse axis $\alpha$. In this embodiment, only one abutment member identical to abutment member 34 (not shown) with two downwardly depending retaining pins is necessary. As shown in FIG. 8, the sheets are consecutively arranged and thereafter placed in the supply hopper, so that the notches in adjacent sheets are offset, and the notches in every other sheet are in linear alignment, as discussed above with respect to the prior embodiment. In this alternate embodiment, the notches again should be sized so as to allow a retaining pin to freely pass through the notch without contacting the edges. The notches on adjacent sheets are positioned to correspond identically with the spacing of the downwardly depending retaining pins 36 and 36A of an abutment member 34. The operation of this alternate embodiment in the process is identical to the prior embodiment discussed above, with the exception that this alternate embodiment is held within the supply magazine along its upper edge 113 by an abutment member at only one position. Although any position along the upper edge can be used, when only one notch is employed, the present invention is found to work satisfactorily when the notches are disposed on either side of the midpoint of transverse axis $\alpha$. In any of the above embodiments additional abutment members or bars can be positioned along the other side edges of the divider within the hopper, for additional support, for example along the lower side of edge 14.

Figure 10:
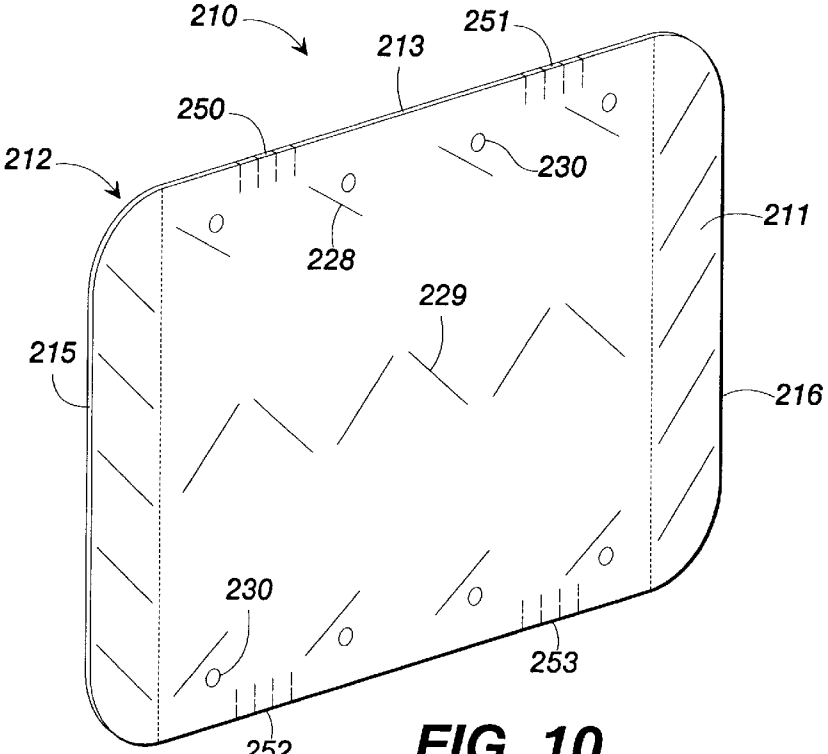
FIG. 10 is an elevational view of another embodiment of the sheet assembly of the present invention.

A third embodiment is shown in FIG. 10. Again, for purposes of illustration, the third embodiment also discloses a divider sheet or divider 210, which is substantially rectangular and planar. As in all embodiments, this third embodiment could perform satisfactorily with any substantially planar article, including those listed above. All elements of divider sheet 210 correspond with a like element on divider sheet 10, except with respect to the notches. As shown in FIG. 10, prior to its being processed, sheet 210 does not include any cut out, open notches such as notches 25 and 26 in divider sheet 10. Instead, sheet 210 includes tabbed engaging areas 250 and 251 along side edge 213, and tabbed engaging areas 252 and 253 along side edge 214. These tabbed engaging areas, such as area 250, comprise structurally weakened side edge areas which are specifically designed and constructed to facilitate the ready removal of a single article, such as a divider sheet, from a supply hopper.

As referenced above, when single articles, such as divider sheets, are removed from a supply magazine by a vacuum engaging transfer device, the transfer device must overcome the forces holding the outermost sheet in place, in order to remove the sheet from the supply hopper. Effort has been devoted in the art to control the amount of pressure exerted by the stack of articles against the outermost article and the downwardly depending retaining clips. There exists an optimum pressure range which permits the most efficient article selection. This pressure range will depend upon many variables, including the type and number of retaining clips, the extent of overlap of the clips over the article side edge, the composition of the article, and the face pressure of the outermost article against the clip. All of these elements relate to some extent to the amount of force which must be overcome to pull the outermost article from beneath the retaining clips. Considering the many variables which come into play, the appropriate pressure of the article stack typically is found by trial and error experimentation. Mechanisms also have been developed to monitor this pressure and to keep this pressure at an optimum level. Such mechanisms are shown in U.S. Pat. application Ser. No. 08/404,225, which is co-owned by the assignee of the present application.

When the optimum pressure is found and maintained by either gravity and the weight of the article stack or by some mechanical means such as a conveyor or forwardly indexing paddles, the article can be efficiently removed from the supply hopper by the vacuum transfer device at high speeds. When this removal is accomplished, the vacuum cups of the transfer device engage the front or outermost surface of the article, usually at at least two locations along the article's longitudinal center line, and pull the article from beneath the retaining clips. During this process step, the article itself deforms by bending outwardly along its central, longitudinal axis. The degree of this deformation increases until the side edges of the article slide beneath and away from the retaining clips. The purpose of this third embodiment of the present invention is to change the structure of the article itself, so that the adjustment of article stack pressure becomes less critical or significant to the transfer process.

Figure 11A:
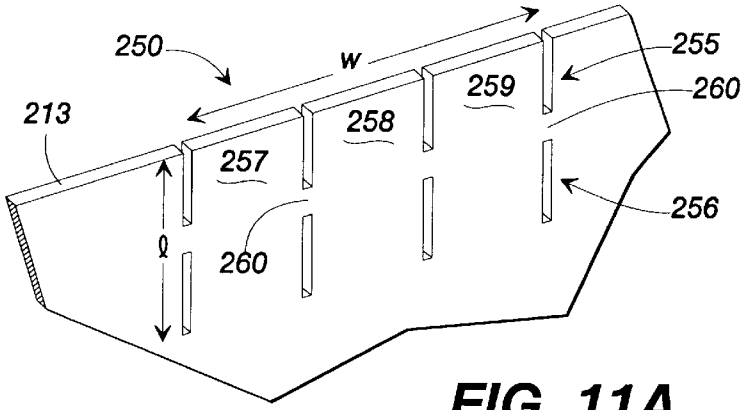
FIG. 11A is an elevational view of the tabbed engaging area of the sheet assembly of FIG. 10.

FIG. 11A shows in detail the structurally weakened, tabbed engagement area 250 of divider sheet 210. This area is generally rectangular, having a width w and a length l. The area includes inwardly extending columns of cuts or slits, defining a first row of slits 255 and a second row of slits 256 spaced inwardly from the first row of slits. In the embodiment shown in FIG. 10, four separate columns of inwardly extending slits 255 and 256 define three tabs 257, 258, and 259. Each column includes one cut 255 and one cut 256 spaced from cut 255. Since the cuts 255 and 256 in each column are spaced from one another, a bridge 260 of the divider sheet material exists between each consecutive column of cuts 255 and 256. This bridge area effectively bridges tab 257 to the body portion of sheet 210, and tab 259 to the body portion of sheet 250. These bridges 260 also connect tab 257 to tab 258, and tab 258 to tab 259, respectively. The function of these bridges will be discussed in further detail below. It should be understood, therefore, that tabbed engaging area 250 is structurally weaker than the remaining side edge 213 of sheet 210. In other words, this weakened area 250 is designed to be readily bent or partially broken away from the remainder of sheet 210.

Figure 11B:
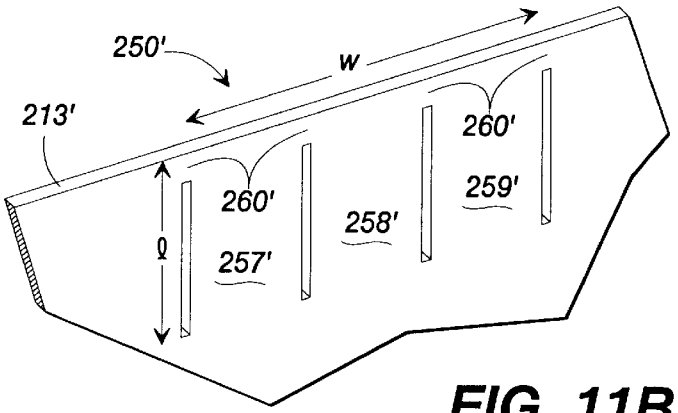
FIG. 11B is an elevational view of another embodiment of the tabbed engaging area of the sheet assembly of the present invention.

FIG. 11B shows another embodiment of the tab engaging area 250' of the sheet assembly of the present invention. Tab engaging area 250' is identical in all respects to tab engaging area 250, except that the bridges 260' of tab engaging area 250' are positioned at or adjacent to side edge 213', as shown in FIG. 11B. Tabbed area 250' includes discrete tabs 257', 258' and 259'. Additionally, the bridges 260' perform the same function as bridges 260, discussed in further detail below.

Figure 12A:
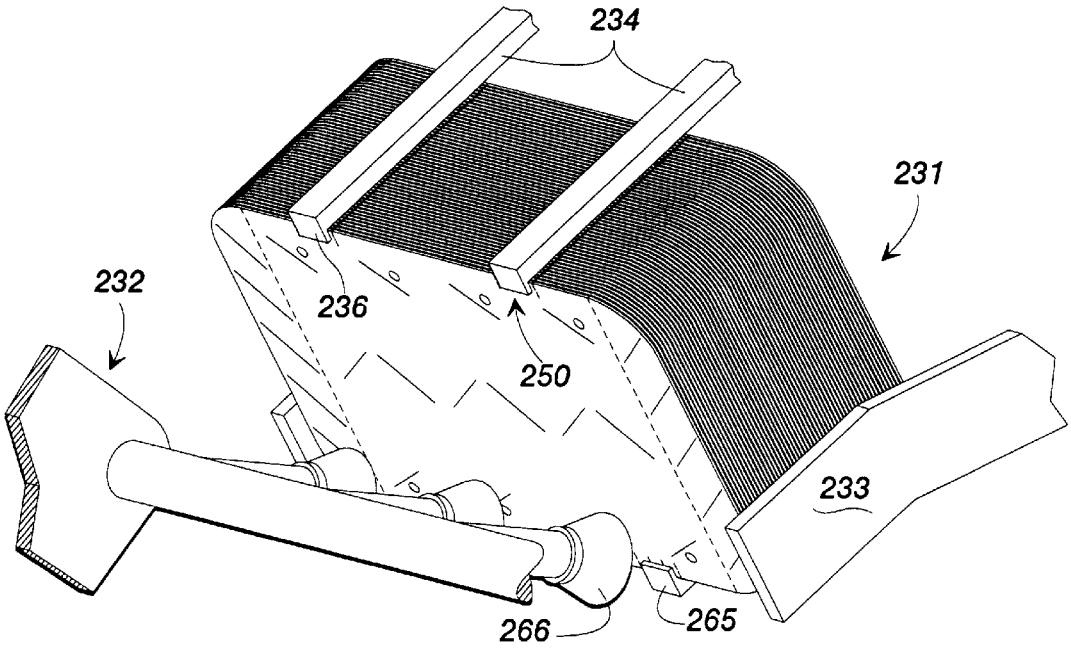
FIG. 12A is a perspective, schematic view of consecutively arranged sheet assemblies of FIG. 10, retained in a supply magazine assembly.

FIG. 12A shows a stack of sheets identical to sheet 210 consecutively arranged in a supply magazine 231, which includes a downwardly extending hopper 233. The embodiment illustrated in FIG. 12A requires two, spaced upper retaining or abutment members 234. Each abutment member 234 includes a single, downwardly extending pin or clip 236. The width w of tabbed area 250 is slightly wider than the width of the retaining pin 236. The placement of tabbed areas 250 and 251 is such that the tabbed areas will abut a respective retaining pin 236 when the divider sheet is the outermost sheet in the stack. All tabbed areas 250 are in linear alignment with one another, and all tabbed areas 251 are in linear alignment with one another when the divider sheets are consecutively arranged in the supply hopper 233. As in most supply magazines 231 of the type ordinarily known in the art, there also are bars or pins, such as pins 265, along the lower edge of the supply magazine to assist in releasably retaining the articles within the magazine. These lower pins 265 extend upwardly, and can correspond to the upper pins 236.

Figure 12B:
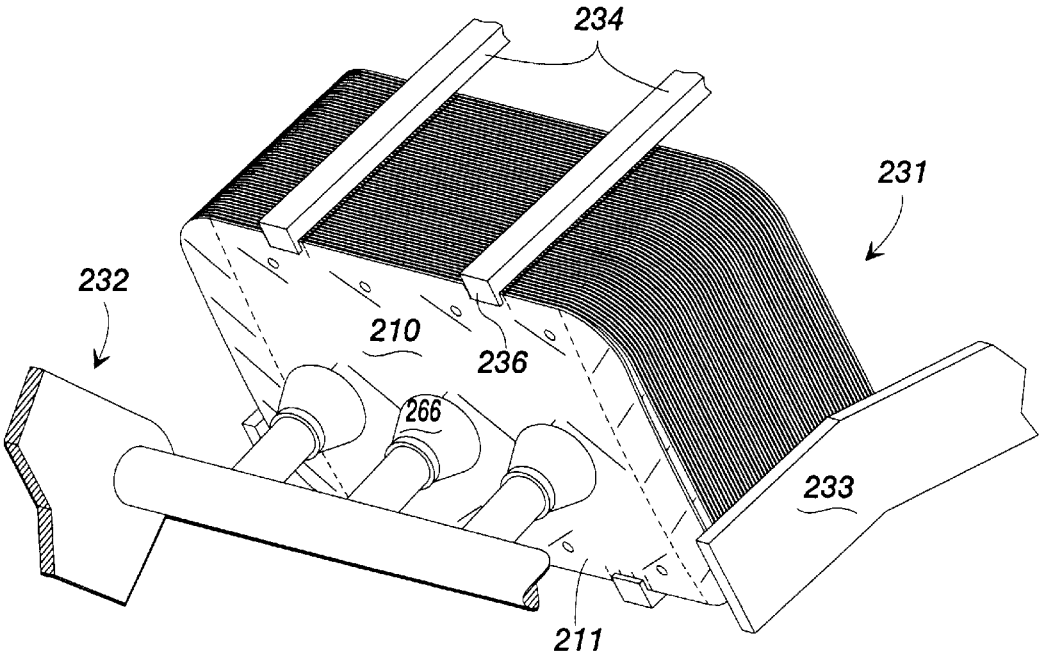
FIG. 12B is a perspective, schematic view of an article transfer device beginning its removal of the sheet of FIG. 10 from a supply magazine assembly.

FIG. 12B shows an article transfer device 232 beginning its selection of sheet 210 from the supply magazine. The transfer device 232 preferably is a type of suction cup device, many configurations of which are well known in the art. As shown in FIG. 12B, the suction cups 266 are contacting the outer surface 211 of sheet 210. Sheet 210 is in the initial stages of being pulled away from supply magazine 231, so that the sheet 210 is being distorted by being bent outwardly, generally along its longitudinal axis, as is typically accomplished in the process of removing divider sheets known in the prior art, from supply magazines.

As discussed, in prior art divider sheets, such as the embodiments above which do not have weakened areas that abut the retaining clips, the sheet must be relatively significantly distorted along its longitudinal axis as the sheet is pulled from beneath the retaining clips. This phenomenon is a result of the extent of overlap of the clips and amount of force between the outermost sheet and the retaining clip which must be overcome in order to pull the sheet from the supply magazine. When the tabbed engagement areas 250 and 251 of the present invention are incorporated into the sheet 210, however, less distortion of the sheet itself is realized, since the tabs will bend and partially break from the remainder of the sheet 210 during the removal process. The greatest distortion in this embodiment, therefore, occurs at the tabbed areas 250 and 251 rather than along the longitudinal axis of the sheet 210.

Figure 12C:
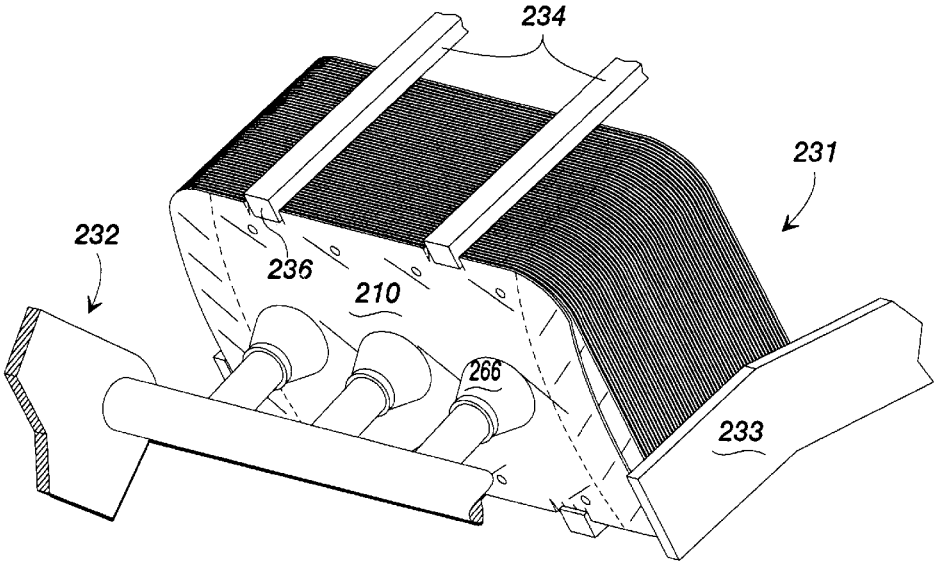
FIG. 12C is a perspective, schematic view of an article transfer device having partially removed the sheet of FIG. 10 from a supply magazine assembly.

FIG. 12C shows a continuation of the removal of the sheet 210 from the supply hopper 233. In FIG. 12C, the tabbed areas 250 and 251 have begun to partially break away from the remainder of the sheet 250, and in some instances, even tabs 257, 258, and 259 have broken away from the adjacent, respective tabs. In other words, the bridged areas 260 between the tab and the body of the sheet and between the tabs themselves break, so that cuts 255 and 256 are joined.

Figure 12D:
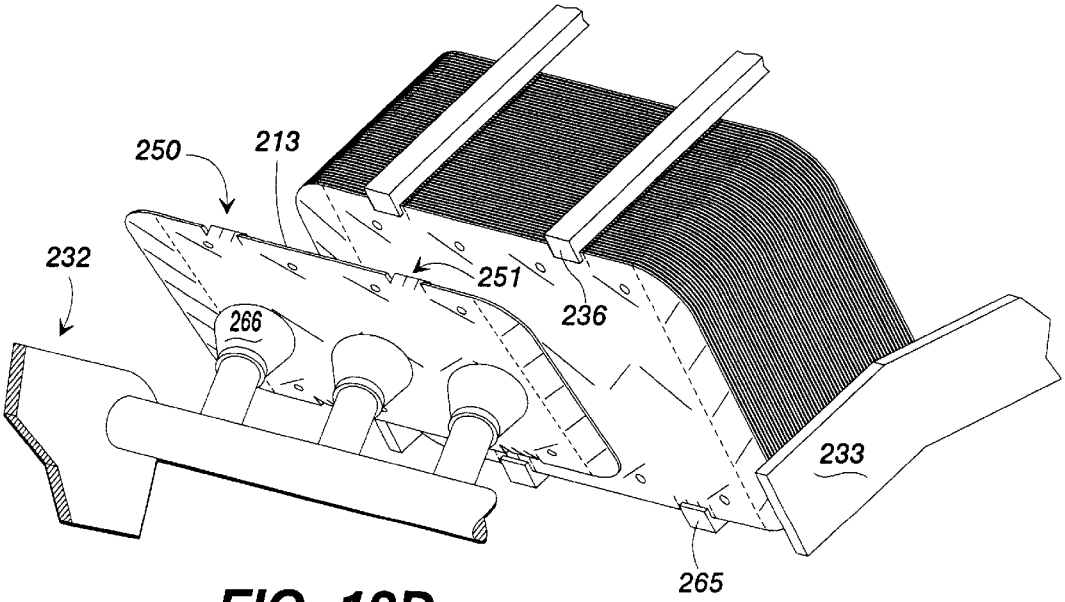
FIG. 12D is a perspective, schematic view of an article transfer device having removed the sheet of FIG. 10 from a supply magazine assembly.

FIG. 12D shows a continuation of the process in which the divider sheet has been entirely removed from the supply hopper. The tabbed areas 250 and 251 have been entirely broken away along their side edges from the body of the divider sheet. Since the tabbed areas remain attached to the body of the sheet along their lower edges, the tabs are bent rearwardly but remain attached to the sheet. It could be considered that after the tabs are bent and partially broken away from the sheet, the area 250 then becomes a notched area which allows the passage of the sheet from the retaining clip 36. It is found that when these tabs or weakened engaging areas are used, less force is necessary to be exerted by the vacuum engagement device 232 in order to remove the sheet 210 from the supply magazine. Therefore, the process is found to be less sensitive to adjustment of force or pressure of the article stack against the clips, or in other words, there is a greater force adjustment which can be met to accomplish efficient article removal. The amount of pressure the article stack exerts against the retaining clips is found to be much less important than in divider sheets of prior embodiments.

It is not absolutely necessary for the operation of the present invention that the bridged areas 260 or 260' be incorporated. These bridges could be eliminated, and the areas 250 and 251 would be even weaker than the preferred embodiments described above. The bridges, however, assist in keeping the tabs in alignment with one another and with the body of the sheet until the tabs are intended to be broken away from the sheet. This is useful in practical aspects, since the sheets must be manufactured, stored and shipped. The existence of the bridges 260 or 260' assists in keeping the tabs from partially breaking away unintentionally, and then interlocking with adjacent tabs when the sheets are stacked and moved. If such interlocking of tabs were to occur prior to the process of their removal from the hopper discussed above, this could interrupt efficient single sheet removal by the transfer device 232.

Additionally, a single, tabbed engaging area 250 could be utilized rather than two spaced, tabbed areas described above. If a single area is used, preferably it is placed along the top side edge 213 at the midpoint or transverse axis $\alpha$ of the sheet. The retaining clip also is positioned at this transverse axis to abut this single tabbed area, and the selection process is the same as above. In all embodiments, the apertures, ridges and indentations optionally may be used to increase the efficiency of the article transfer process.

Wherefore, the following is claimed:

1. A sheet for being removably supported in a supply magazine having retaining means for engaging said sheet, said sheet being substantially planar and having a first side and a second side opposing said first side, a first edge defined adjacent said first and second sides, said sheet including a retaining means engaging area defined along said first edge, said retaining means engaging area including a tab defined by spaced slits cut into said sheet inwardly from said first edge, said sheet further having an indentation in said first side and a corresponding ridge in said second side.

2. The sheet of claim 1, said retaining means engaging area including a bridge comprised of said sheet joining said tab to said sheet.

3. A sheet for being removably held by a sheet supply hopper having means for retaining said sheet within said supply hopper, comprising a substantially planar sheet having a first side which define a first edge, said first edge including a weakened area positioned to abut said retaining means when said sheet is held in said supply hopper said sheet further having an indentation in said first side and a corresponding ridge in said second side.

4. The sheet of claim 3, said weakened area comprising a tab defined adjacent to said first edge by two spaced cuts through said sheet adjacent said first edge.

5. The sheet of claim 4, said sheet being substantially rectangular and including rounded edges.

6. The sheet of claim 4, said sheet being substantially square and including rounded edges.

7. The sheet of claim 3, said weakened area comprising a tab having two opposing tab side edges defined in said edge by two cuts through said sheet adjacent said first edge, and a bridge formed between at least one tab side edge and said sheet.

8. The sheet of claim 3, said weakened area comprising numerous adjacent tabs defined in said first edge by at least three spaced cuts through said sheet adjacent said first edge.

9. The sheet of claim 8, said sheet including two weakened areas spaced from one another along said first edge, said weakened areas being positioned along said first edge to each abut said retaining means when said sheet is held in said supply hopper.

10. The process of supplying a substantially planar article having a top edge from a supply hopper by an article transfer device having at least two spaced upper abutment members with integral corresponding retaining pins abutting said planar article's top edge, to a preselected area, comprising:

a. disposing said planar article in said supply hopper by orienting said planar article on a first side edge, said planar article having a second side edge including at least two structurally weakened areas and a forward surface;

b. releasably engaging said planar article by said article transfer device having a retaining pin, said retaining pin abutting said planar article;

c. removing said planar article from said supply hopper, said structurally weakened area being, deformed as said weakened areas are forced against said corresponding retaining pin during said process of removing.

11. The process of claim 10, said engaging of said planar article including releasably attaching said article transfer device to said planar article by vacuum engaging.

12. The process of claim 10, said structurally weakened area being defined by being bent rearwardly and away from said forward surface.

13. The process of supplying an article having a first edge, a second edge spaced from said first edge, a first surface and a second surface opposing said first surface, from a supply location to a preselected location, using an article transfer device, said first surface having an indentation therein, said second surface having a corresponding ridge therein, comprising:

a. orienting said article at said supply location by resting said article on said first edge, said article including a tab along said second side edge;

b. contacting said tab with a means for releasably retaining said article in said supply location;

c. releasably engaging said article with said article transfer device;

d. progessively moving said article in a direction away from said supply location; and e. structurally distorting said tab as said article is progressively moved from said supply location.

14. The process of claim 13, said tab being formed by cutting slits into said article along said second side edge, said slits extending from said second side edge into said article.

15. The process of claim 13, said defining of said tab accomplished by forcing said article against said means for retaining said article in said supply location.

16. The process of claim 13, said releasably engaging said article accomplished by creating a vacuum between the first surface of said article and said article transfer device.

17. The process of claim 15, said tab being defined by bending said tab away from said first surface of said article.

18. The process of claim 13, said article comprising a substantially planar sheet.

19. The process of claim 18, said tab being formed by cutting slits into said second side edge.

20. An apparatus for individually delivering each sheet in a stack of sheets to a desired location with each sheet having first and second notches along one edge of said sheet and with one of said first or second notches being formed at a first distance from a midpoint along said one edge of said sheet and the other of said notches being formed at said first distance minus a second distance from said midpoint, wherein a first group of sheets have said first notch formed at said first distance, a second group of sheets have said second notch formed at said first distance, and said sheets are placed in said stack so that sheets from said first group alternate with sheets from said second group, said apparatus comprising:

a first abutment member placed at one end of said stack of sheets along said one edge and on one side of said midpoint, said first abutment member having a first retaining pin placed at said first distance along said one edge of said sheet and a second retaining pin placed at said first distance minus said second distance, one of said first or second retaining pins for contacting an outermost sheet in said stack of sheets and the other of said first or second retaining pins for passing through said first notch in said outermost sheet and for contacting a second sheet in said stack of sheets;

a second abutment member placed at said one end of said stack of sheets along said one edge and on an opposite side of said midpoint as said first abutment member, said second abutment member having a third retaining pin placed at said first distance along said one edge of said sheet and a fourth retaining pin placed at said first distance minus said second distance, one of said third or fourth retaining pins for contacting said outermost sheet in said stack of sheets and the other of said third or fourth retaining pins for passing through said second notch in said outermost sheet and for contacting said second sheet in said stack of sheets; and means for individually removing each sheet in said stack of sheets in consecutive order beginning with said outermost sheet.

21. A sheet for being removably held by a sheet supply hopper having means for retaining said sheet within said supply hopper, comprising a substantially planar sheet having a first side and a second side opposing said first side which define a first edge, said first edge including a weakened area positioned to abut said retaining means when said sheet is held in said supply hopper, said weakened area comprising a plurality of adjacent tabs defined in said first edge by at least three spaced cuts through said sheet adjacent said first edge, said sheet including two weakened areas spaced from one another along said first edge, said weakened areas being positioned along said first edge to each abut said retaining means when said sheet is held in said supply hopper.

* * * * *